US006257845B1

(12) United States Patent
Jack et al.

(10) Patent No.: US 6,257,845 B1
(45) Date of Patent: Jul. 10, 2001

(54) AIR DRIVEN PUMPS AND COMPONENTS THEREFOR

(75) Inventors: Robert F. Jack, Riverside; Eric L. Forman, Rancho Cucamonga; James E. Humphries, Hesperia; Gary K. Lent, Chino Hills, all of CA (US)

(73) Assignee: Wilden Pump & Engineering Co., Grand Terrace, CA (US)

( * ) Notice: Subject to any disclaimer, the term of this patent is extended or adjusted under 35 U.S.C. 154(b) by 0 days.

(21) Appl. No.: 09/115,287

(22) Filed: Jul. 14, 1998

(51) Int. Cl.[7] ..... F04B 43/06; F04B 45/00

(52) U.S. Cl. ..... 417/395; 91/329; 92/99; 92/100

(58) Field of Search ..... 417/395; 92/99, 92/100; 91/329

(56) References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| 4,242,941 | 1/1981 | Wilden et al. | 91/319 |
| 4,247,264 | 1/1981 | Wilden | 417/393 |
| 4,549,467 | 10/1985 | Wilden et al. | 91/307 |
| 5,145,336 | 9/1992 | Becker et al. | 417/413.1 |
| 5,169,296 | 12/1992 | Wilden | 417/395 |
| 5,213,485 | 5/1993 | Wilden | 417/393 |
| 5,240,390 | 8/1993 | Kvinge et al. | 417/393 |
| 5,567,118 | 10/1996 | Grgurich et al. | 417/46 |
| 5,649,809 | 7/1997 | Stapelfeldt | 417/63 |
| 5,927,954 | 7/1999 | Kennedy et al. | 417/397 |
| 5,957,670 | 9/1999 | Duncan et al. | 417/395 |

*Primary Examiner*—John A. Jeffery
*Assistant Examiner*—Vinod D Patel
(74) *Attorney, Agent, or Firm*—Lyon & Lyon LLP

(57) ABSTRACT

An air driven double diaphragm pump including two opposed pump chambers with an air motor having air chambers therebetween. The pump chambers and air chambers form pumping cavities divided by diaphragms. Each pump chamber includes an inlet ball valve and outlet ball valve. An inlet manifold is positioned below the pump chambers and an outlet manifold above. Tie-rods extend both across the pump from one pump chamber to the other with nuts to place the assembly in compression. Tie-rods also extend from the outlet manifold through the pump chambers, to the inlet manifold and to feet mounted therebelow. Two plates, one to either side of the air motor extend to grooves in the inlet and outlet manifold and also extend to grooves in the pump chambers so as to close of the side of the pump structure. With the plates, an outlet manifold is provided from which air may be exhausted remotely. The ball valves include small diametrical clearance and a limitation on lift for added performance. The ball valves also include seats which are sealed with the components of the pump through the use of O-rings and surfaces polished to $10R_A$. Belleville washers relieve thermal stresses on the tie-rods. Integrally molded diaphragms include an annular sheet about a hub. A semi-circular corrugation about the periphery provides for attachment to the pump while a cylindrical flange mates with a boss on the respective pump chamber. A stud is molded as an insert into the diaphragm. The pullout failure rate of the stud is empirically established by appropriate sizes of circumferential ribs and hub thickness to be higher than the rupture rate for the annular sheet. Thus, failure occurs before air chamber contamination.

4 Claims, 7 Drawing Sheets

AIR DRIVEN PUMPS AND COMPONENTS THEREFOR

BACKGROUND OF THE INVENTION

The field of the present invention is air driven reciprocating devices.

Pumps having double diaphragms driven by compressed air directed through an actuator valve are well known. Reference is made to U.S. Pat. Nos. 5,213,485; 5,169,296; and 4,247,264; and to U.S. Pat. Nos. Des. 294,946; 294,947; and 275,858. Actuator valves using a feedback control system are disclosed in U.S. Pat. Nos. 4,242,941 and 4,549,467. The disclosures of the foregoing patents are incorporated herein by reference.

Common to the aforementioned patents on air driven diaphragm pumps is the disclosure of two opposed pumping cavities. The pumping cavities each include a pump chamber housing, an air chamber housing and a diaphragm extending fully across the pumping cavity defined by these two housings. Each pump chamber housing includes an inlet check valve and an outlet check valve. A common shaft typically extends into each air chamber housing to attach to the diaphragms therein.

An actuator valve receives a supply of pressurized air and operates through a feedback control system to alternately pressurize and vent the air chamber side of each pumping cavity through a control valve piston. Feedback to the control valve piston has been provided by the position of the diaphragms. This may be through the shaft attached to the diaphragms which includes one or more passages to alternately vent the ends of the valve cylinder within which the control valve piston reciprocates. Alternatively, relief valves may include actuators extending into the path of the diaphragm assembly such as disclosed in U.S. Pat. No. 5,927,954, the disclosure of which is incorporated herein by reference. By selectively venting one end or the other of the cylinder, the energy stored in the form of compressed air at the unvented end of the cylinder acts to drive the piston to the alternate end of its stroke.

The use of air driven diaphragm pumps has expanded in recent years. Use of the pumps in chemically reactive applications and ultra-clean applications has put stringent requirements on such pumps regarding materials and safety features. High temperature applications provide further issues with regard to design and material selection.

SUMMARY OF THE INVENTION

The present invention is directed to an air driven diaphragm pump and components therefor which can operate cleanly in adverse chemical and temperature conditions.

In one aspect of the present invention, a diaphragm for an air driven diaphragm pump includes an integrally molted PTFE annular sheet and hub with a stud extending therefrom. The stud includes a head within the hub and a shredded shank extending from one side. Empirical testing may be employed to establish the wear limits of the retention of stud head within the hub such that the stud will be pulled from the hub before a failure by rupture of the annular sheet. Stress on the hub and stud coupling occurs on the vacuum stroke for the diaphragm. When the head of the stud is extracted, further pumping ceases and leakage through a ruptured diaphragm is avoided.

Accordingly, it is an object of the present invention to provide improved mechanisms and systems for air driven diaphragm pumps. Other and further objects and advantages will appear hereinafter.

DETAILED DESCRIPTION OF THE PREFERRED EMBODIMENT

Figure 1:
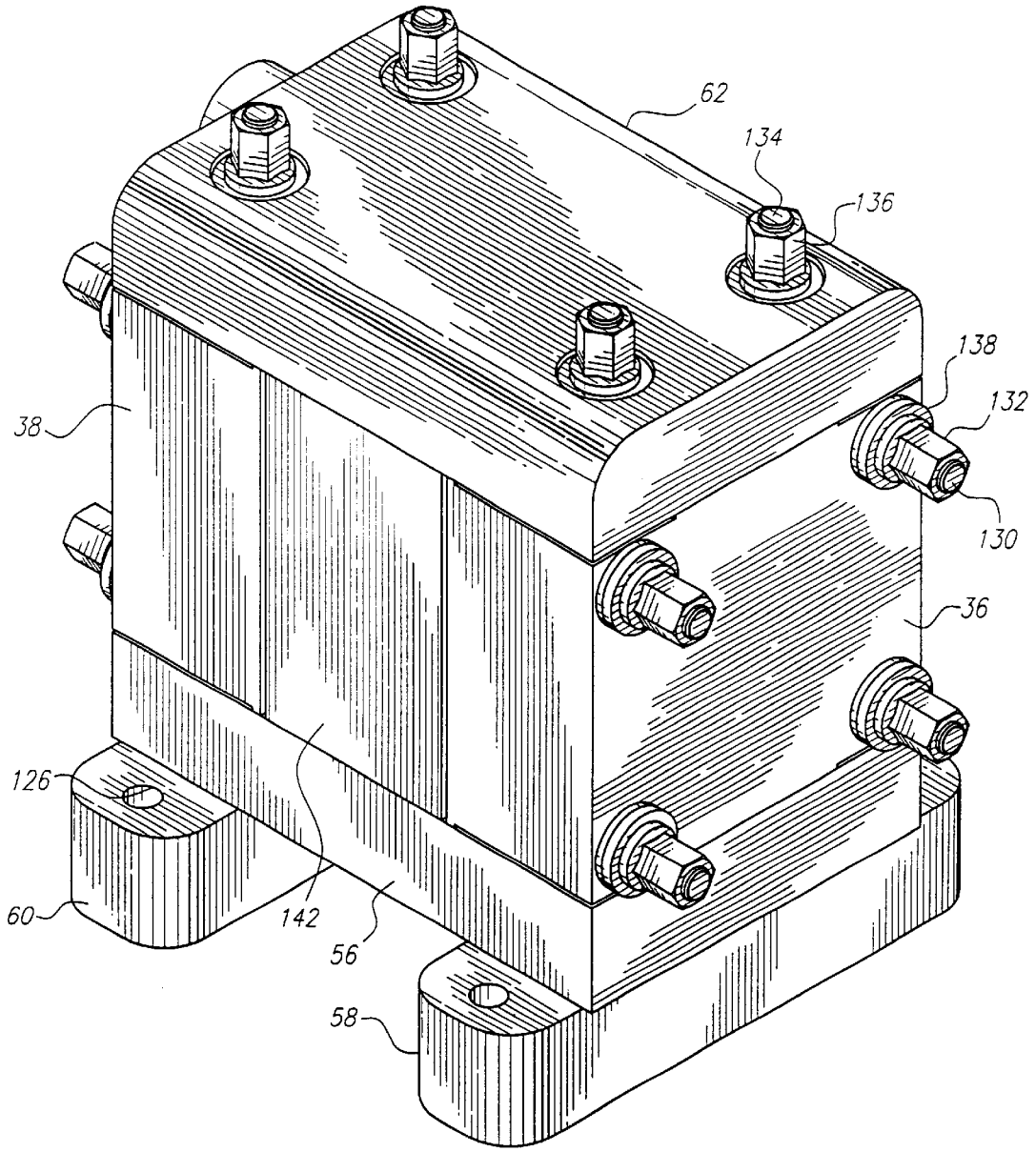
FIG. 1 is a perspective view of an air driven double diaphragm pump.
Figure 2:
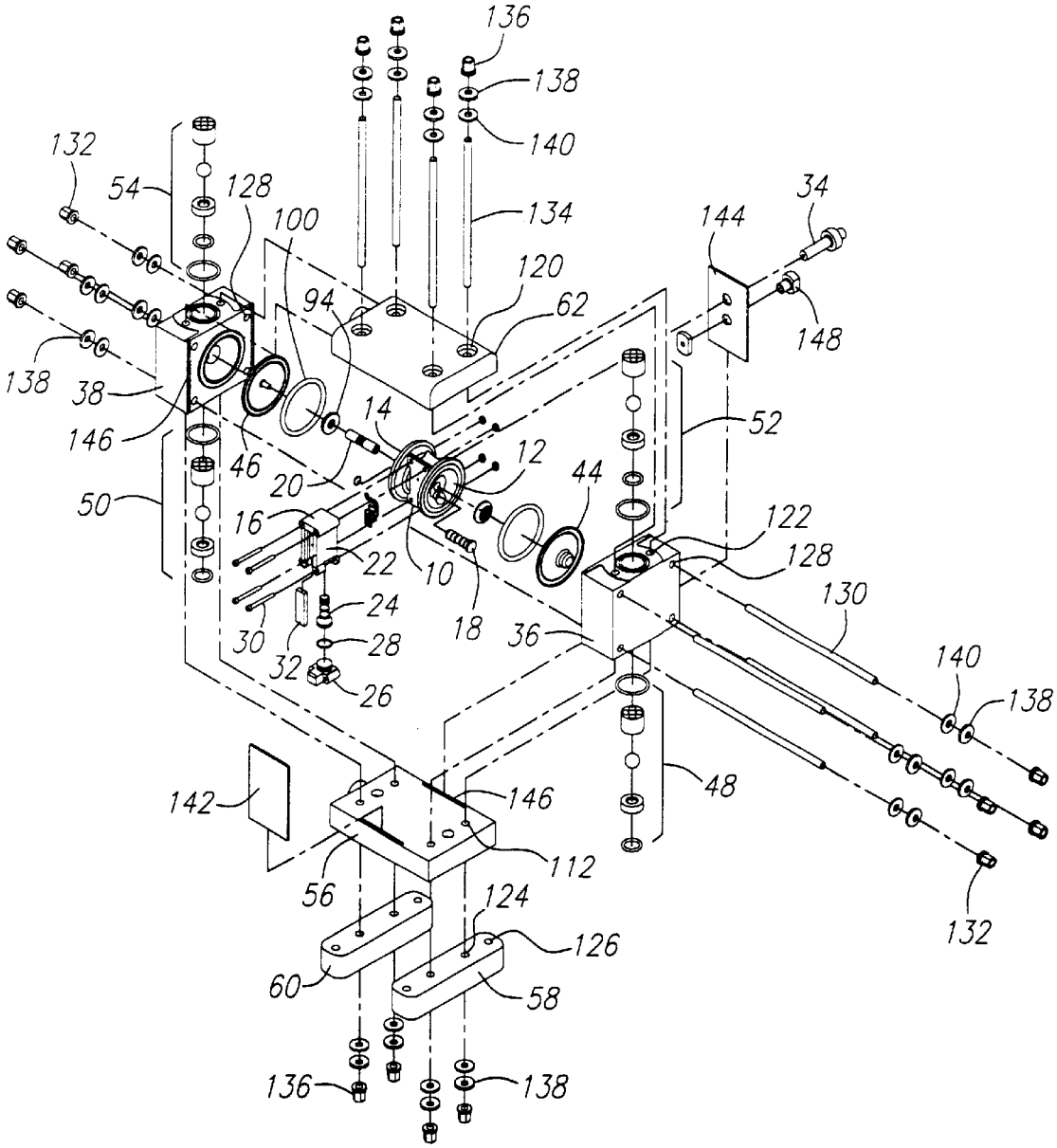
FIG. 2 is an exploded assembly view of the pump of FIG.
Figure 3:
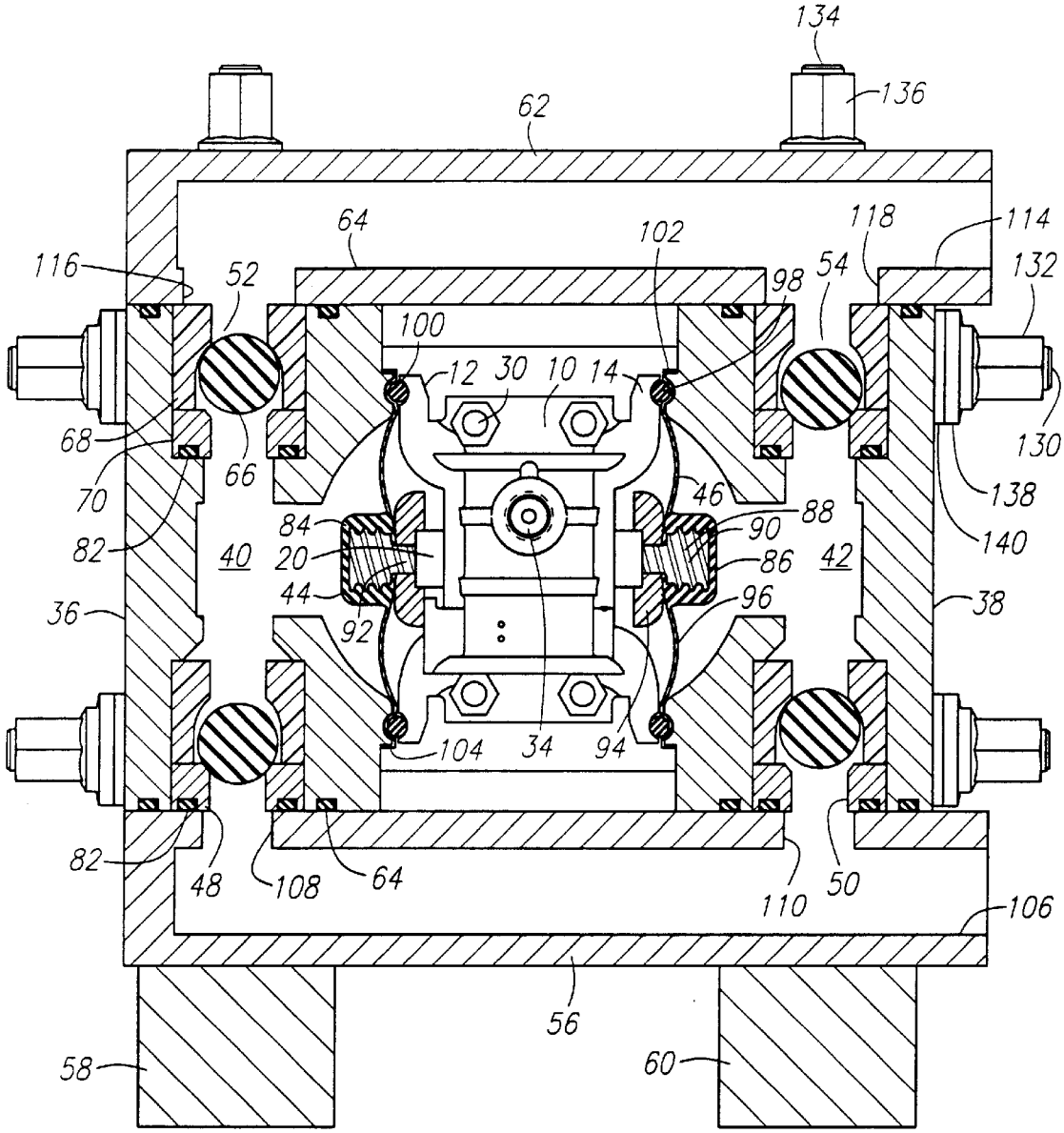
FIG. 3 is a cross-sectional view of the pump of FIG. 1.
Figure 4:
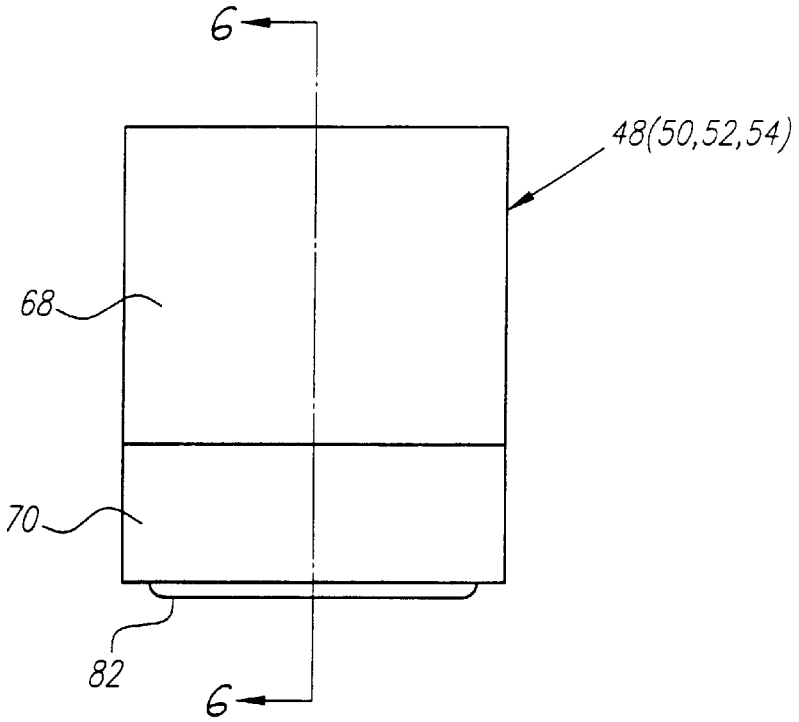
FIG. 4 is a front view of a ball valve.
Figure 6:
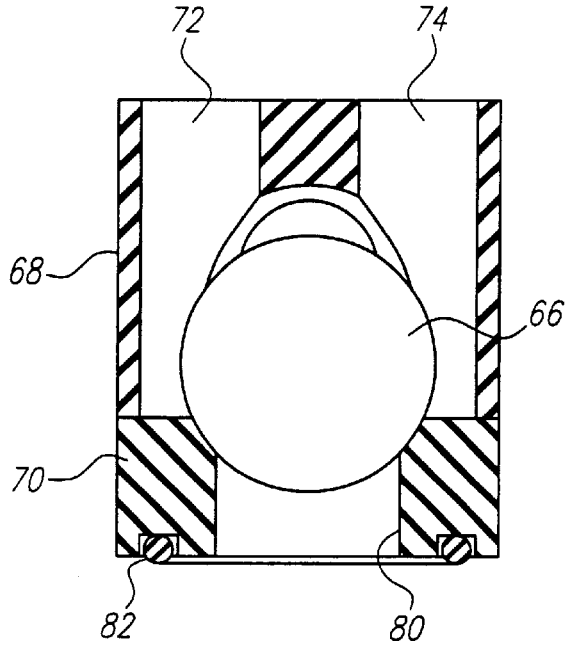
FIG. 6 is a cross-sectional view of the ball valve of FIG. 4 taken along line 6—6.
Figure 5:
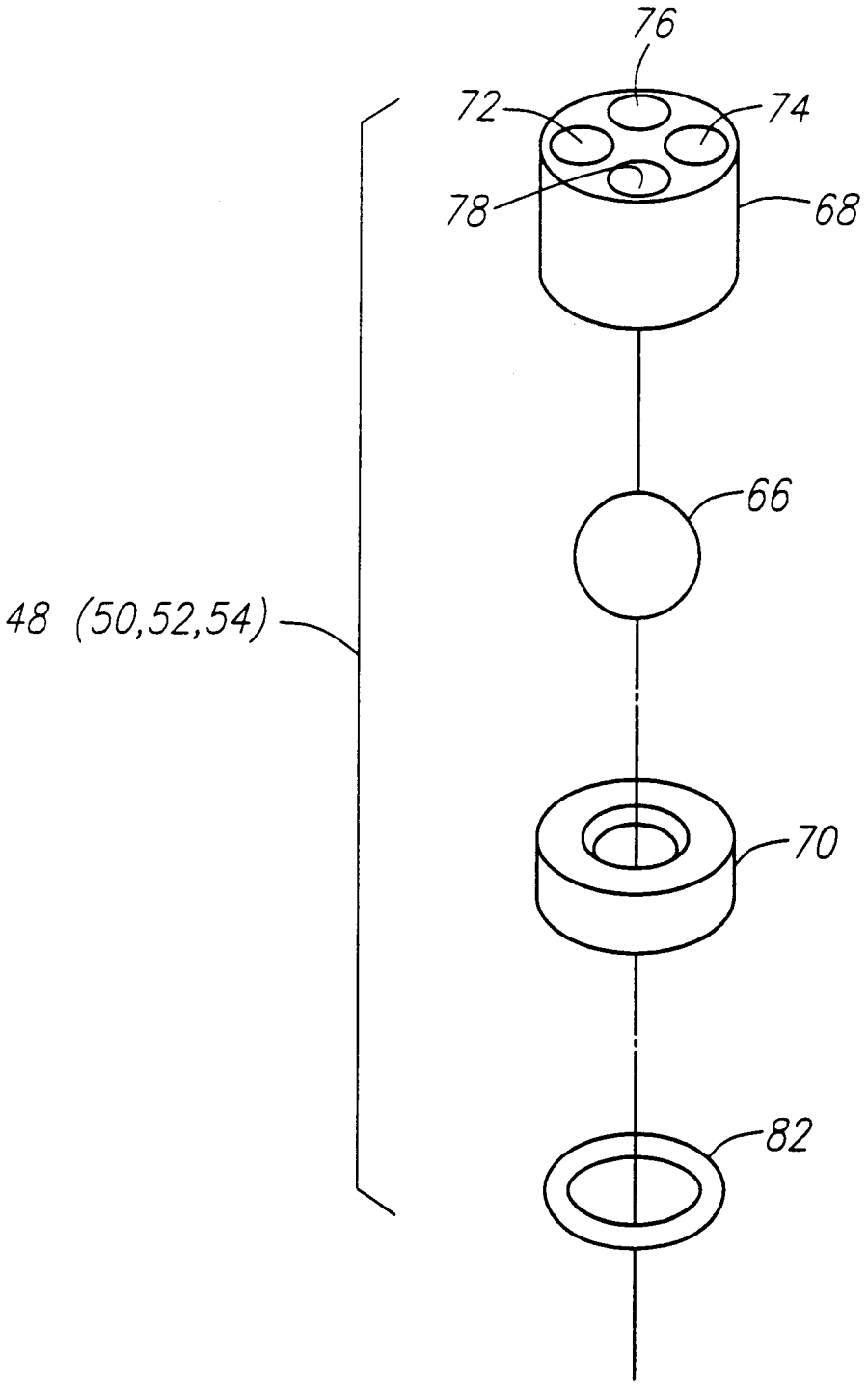
FIG. 5 is an exploded assembly of the ball valve of FIG. 4.
Figure 8:
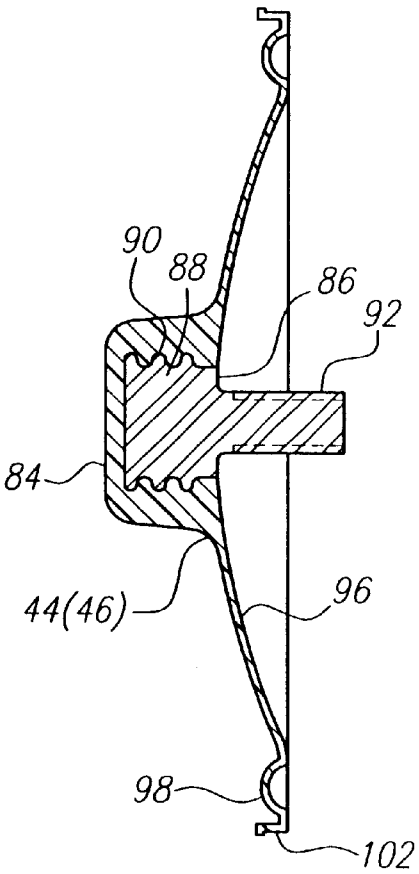
FIG. 8 is a cross-sectional view of the diaphragm of FIG. 7.
Figure 7:
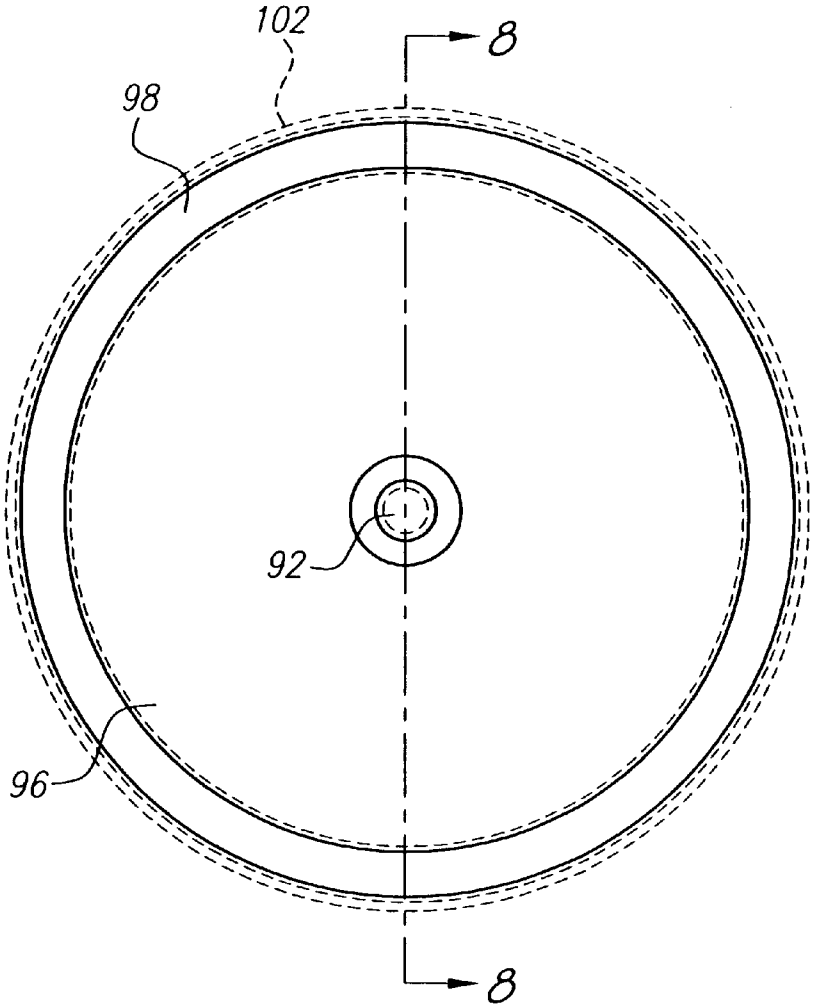
FIG. 7 is a plan view of a diaphragm.

Turning in detail to the drawings, an driven diaphragm pump is illustrated in FIGS. 1, 2 and 3. Except where noted, the pump is contemplated to be PTFE or other appropriate polymer. The pump includes an air motor center section 10 which provides the actuator system for the pump. One such system applicable to the present invention is disclosed in U.S. Pat. No. 5,607,290, issued Mar. 4, 1997, the disclosure of which is incorporated herein by reference. Two opposed air chambers 12 and 14 are included as part of the air motor 10. The air chambers 12 and 14 face in opposite directions with an air valve 16 therebetween. Components of the air valve illustrated in FIG. 2 include a pilot shifting shaft 18, a center shaft 20 and a valve cylinder 22 with an unbalanced valve piston 24 held in place by an end cap 26 sealed with an O-ring 28. The valve cylinder 22 is held to the side of the body of the air valve 16 by fasteners 30. An exhaust defuser 32 is found to one side of the air valve assembly while an inlet coupling 34 extends to the air valve 16 from the other side.

Pump chambers 36 and 38 are positioned to either side of the air motor 10 and are arranged to mate with the air chambers 12 and 14, respectively, to define pumping cavities 40 and 42 divided by diaphragms 44 and 46. The pump chambers 36 and 38 each include inlet ball valves 48 and 50 and outlet ball valves 52 and 54.

An inlet manifold 56 extends across the bottom of the pump chambers 36 and 38. Feet 58 and 60 support the inlet manifold 56 and in turn the entire pump. An outlet manifold 62 extends across the top of the pump chambers 36 and 38. A general sealing between the inlet manifold 56, the outlet manifold 62 and the two pump chambers 36 and 38 is provided by O-rings 64 set within circular grooves in the pump chambers 36 and 38.

Having generally described the components of the pump, attention is directed to various details. The ball valves 48, 50, 52 and 54 each include a ball 66, a ball cage 68 and a seat 70. The ball cage 68 is cylindrical in shape with four holes 72, 74, 76 and 78, which are equiangularly spaced about and parallel to a central axis of the ball cage 68. A cavity 80 extends part way through the cage 68 and has a domed inner end. The cavity 80 intersects the holes 72–78 to provide passageways fully through the cage 68. The cavity 80 is configured such that there is a 0.016" diametrical clearance between the ball 66 and the cage 68 measured at room temperature. As the cage 68 and the ball 66 are contemplated to be PTFE, clearance may be at a minimum. However, as the pump is contemplated to be operated at elevated temperatures, some clearance advantageously prevents sticking of the components because of thermal expansion. By maintaining the clearance at a minimum, ball chatter as it is seating is kept to a minimum. This impacts both noise and efficiency of the pump.

The lift of the ball 66 within the cage 68 is kept at 0.100" from the seated position. Even greater lift can positively impact on flow rates. However, with increased lift, self-priming performance decreases. The ratio of the diametrical clearance establishes a relevance of the two measurements without reference to scale. Depending on the demands for self-priming, the lift can increase in proportion to the diametrical clearance.

Continuing to consider the ball valves 48–54, the valve seats 70 are shown to each include a cylindrical groove in which an O-ring 82 seats. With the inlet ball valves 48 and 50, the seats 70 are positioned on the inlet manifold 56. With the outlet ball valves 52 and 54, the seats 70 seal with the pump chambers 36 and 38. In either case, the surfaces directly contacted by the O-rings 82 are polished to at least $10R_A$ such that the elastomeric O-rings 82 seal completely with the PTFE surfaces. The seals thus formed may be reversed in the sense that the O-rings are positioned in grooves on the body parts of the pump and the polished surfaces are provided by the seats 70.

Turning to the diaphragms 44 and 46, they are contemplated to be formed of molded PTFE. A hub 84 is located centrally in each of the circular diaphragms 44 and 46. The diaphragms are integrally molded with a central insert which is a metal stud 86. The stud 86 includes a head 88 with circumferential ribs 90 which are shown to be in the nature of cut threads. The stud 86 also includes a threaded shank 92 which extends through piston elements 94 and fastens into the center shaft 20 extending through the air motor center section An annular sheet 96 extends outwardly from the hub 84 to form the body of the diaphragm. A semi-circular corrugation 98 extends about the periphery of the annular sheet 96 to receive an O-ring 100. The air chambers 12 and 14 and the pump chambers 36 and 38 include annular grooves to receive the corrugations 98 and the O-rings 100 on the diaphragms 44 and 46 as best seen in FIG. 3.

Outwardly of the semi-circular corrugations 98, cylindrical flanges 102 are provided on the diaphragms 44 and 46. Cylindrical bosses 104 are found on the inner faces of the pump chambers 36 and 38 facing toward the air motor center section 10 to receive the cylindrical flanges 102. The bosses 104 facilitate placement of the diaphragms 44 and 46 through cooperation with the cylindrical flanges 102.

The diaphragms 44 and 46 are typically the most wear prone components within an air driven double diaphragm pump. Ultimately, such diaphragms will fail due to repeated flexure. Another point of possible failure of diaphragms according to the current design is the extraction of the stud 86 from the hub 84. Force is experienced in this assembly when the diaphragm is operating in the suction stroke. As the air chamber on the other side of the pump is being pressurized, the center shaft 20 is pulling on the stud 86 and in turn the hub 84. Over time, the head 88 can be pulled from the hub 84 during such a stroke. Through empirical testing, the head 88 and the hub 84 can be configured along with the circumferential ribs 90 such that failure of the diaphragm due to extraction of the stud 86 can provide planned obsolescence at a point prior to rupture of the annular sheet 96. As the hub 84 and annular sheet 96 are all integral, the extraction of the stud 86 does not break the barrier between the air side and the fluid side of the pumping cavities. Once extracted, the center shaft 20 will not be forced to follow the diaphragm when pressurized air is introduced. Consequently, the pump will cease to shift and will stall without leakage into the air side of the pump.

The inlet manifold 56 and the outlet manifold 62 are similarly constructed. The inlet manifold 56 is relatively flat, top and bottom, and includes a cylindrical inlet 106 with holes 108 and 110 to provide access to the inlet ball valves 48 and 50. The flat bottom receives the feet 58 and 60 while the flat top receives the pump chambers 36 and 38. As noted above, a polished surface area is provided for sealing with the seats 70 of the inlet ball valves 48 and 50. Outwardly of the cylindrical inlet 106, bolt holes 112 extend vertically through the inlet manifold 56.

The outlet manifold includes a cylindrical outlet 114 communicating with the outlet ball valves 52 and 54 through holes 116 and 118. The upper surface is rounded and has bolt holes 120 which are aligned with the bolt holes 112 in the inlet manifold 56. Holes 122 extend through the pump chambers 36 and 38 to align with the bolt holes 112 and 120.

Bolt holes 124 are also in the feet 58 and 60 and are countersunk. Other anchoring holes 126 are positioned outwardly of the bolt holes 124 in the feet 58 and 60 to allow fastening of the pump to a supporting surface.

The pump chambers 36 and 38 include bolt holes 128 extending through the four corners. They are arranged outwardly of the air motor 10 so that the air motor 10 will not interfere with fasteners extending through these holes 128. The pump is held together by a cross bolt assembly. Fasteners extend in one direction through the bolt holes 128 in the pump chambers 36 and 38 to compress the pump chambers together with the air motor 10 therebetween. The fasteners extending through the bolt holes 128 include tie-rods 130 which are made from a 70% glass filled epoxy vinyl ester. Shoulders are defined on the tie-rods 130 to place them in tension by nuts 132. The nuts 132 are made from 40% glass filled polyphenylene sulfide. The tie-rods 130 are threaded on either end to receive the nuts 132. Similarly, tie-rods 134 extend vertically through the outlet manifold 62, the inlet manifold 56 and the pump chambers 36 and 38. Nuts 136 are similarly associated with the tie-rods 134. Countersunk bolt holes in the feet accommodate the nuts 132 so that the feet can provide a flat mounting surface.

Figure 9:
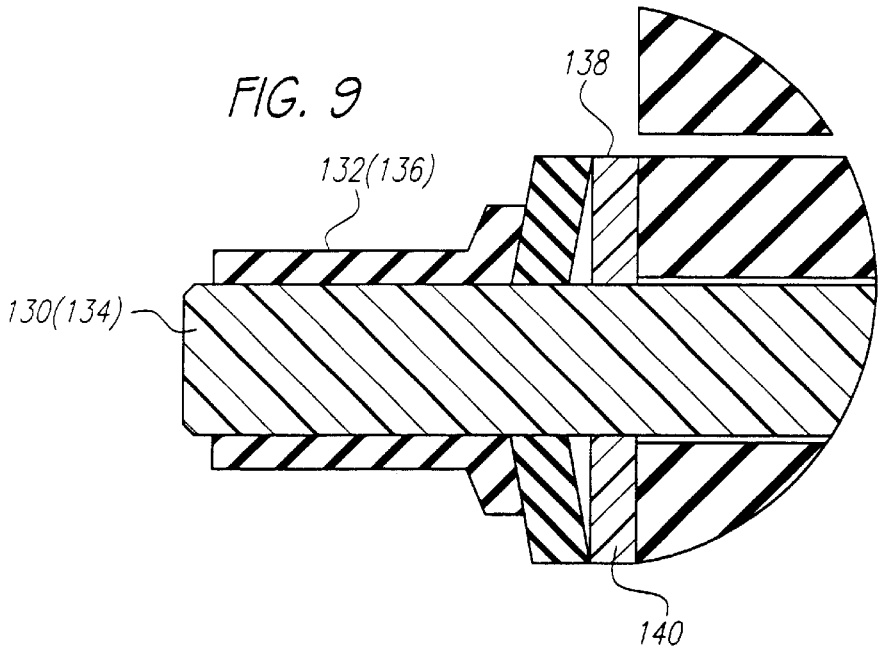
FIG. 9 is a Belleville washer and fastener assembly in cross-section.
Figure 10:
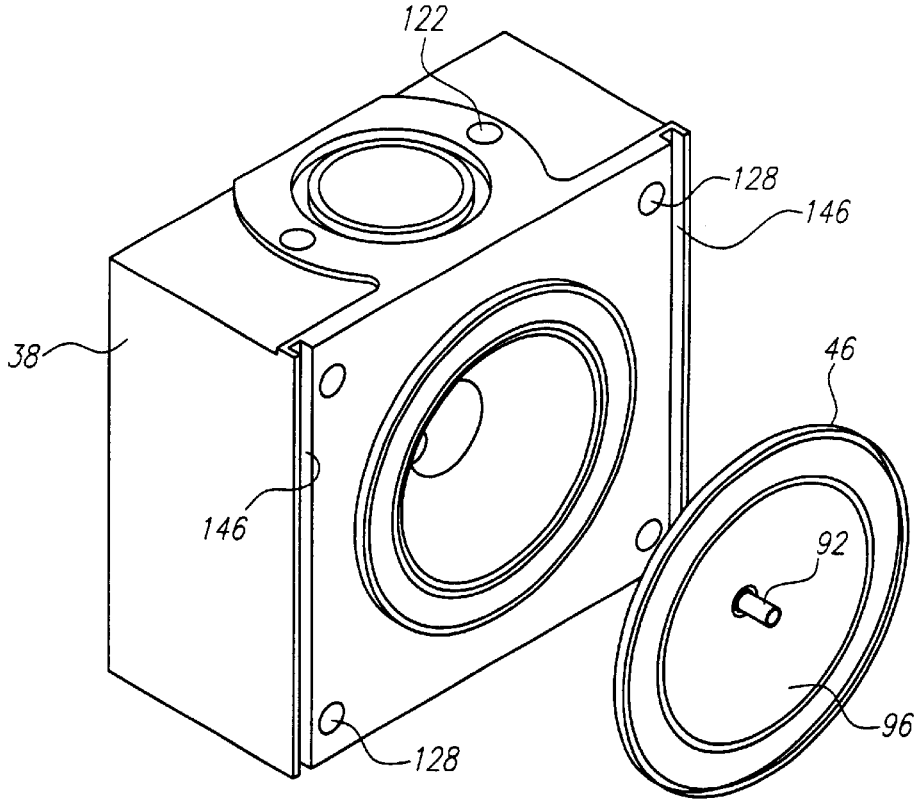
FIG. 10 is an exploded assembly view of a diaphragm and pump chamber in perspective.

Subjecting the pump to substantial temperatures can have an effect on the compressive abilities of the tie-rods 130 and 134. To maintain the rods intention through substantial thermal cycling, Belleville washers are employed. FIG. 9 illustrates the detail of these conical washers 138 in association with flat washers 140 and the nuts 132 (136). The washers are made of polyetheretherketone reinforced with glass or carbon fiber.

Plates 142 and 144 are arranged to either side of the air motor center section 10. Grooves 146 are placed on the inner sides of the pump chambers 36 and 38 and the inlet manifold 56 and outlet manifold 62 to receive the periphery of each of the plates 142 and 144. When the components are drawn together, a seal is created with the plates such that the interior volume around the air motor center section 10 forms an exhaust manifold. An outlet 148 provides a coupling which can accommodate a conduit for directing exhausted air to a remote location for clean room applications. The inlet coupling 34 also extends through the plate 144.

Accordingly, an improved air driven double diaphragm pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An air driven diaphragm pump comprising a first pump chamber;

a second pump chamber;

an air motor including a first air chamber, a second air chamber and an air valve, the first air chamber and the second air chamber facing in opposite directions with the air valve therebetween, the first pump chamber facing the first air chamber and the second pump chamber facing the second air chamber;

an inlet manifold to a first side of the first and second pump chambers;

an outlet manifold to a second side of the first and second pump chambers opposite the first side;

a first diaphragm between the first pump chamber and the first air chamber;

a second diaphragm between the second pump chamber and the second air chamber, each diaphragm including an integrally molded PTFE annular sheet and hub and a threaded stud having a head and a threaded shank, the head including circumferential ridges, the hub being molded about the head.

2. The air driven diaphragm pump of claim 1, the pullout strength of the heads from the hub being less than the rupture strength of the annular sheet.

3. A diaphragm for an air driven diaphragm pump, comprising an integrally molded PTFE annular sheet and hub;

a threaded stud having a head and a threaded shank, the head including circumferential ridges, the hub being molded about the head.

4. The diaphragm of claim 3, the pull-out strength of the heads from the hub being less than the rupture strength of the annular sheet.

* * * * *